US006813869B1

(12) United States Patent
Gaylor et al.

(10) Patent No.: US 6,813,869 B1
(45) Date of Patent: Nov. 9, 2004

(54) WAX SCENTED ANIMALS AND METHOD OF FABRICATION

(76) Inventors: Larry F. Gaylor, 406 County, Lincoln, AR (US) 72744; Gary Cross, 189 Riverdale Dr., West Fork, AR (US) 72774

( * ) Notice: Subject to any disclaimer, the term of this patent is extended or adjusted under 35 U.S.C. 154(b) by 0 days.

(21) Appl. No.: 10/021,483

(22) Filed: Dec. 7, 2001

(51) Int. Cl.[7] ..... B65B 1/20
(52) U.S. Cl. ..... 53/428; 53/431; 53/440
(58) Field of Search ..... 53/415, 428, 431, 53/440; 44/275; 431/288, 289; 427/416, 417, 363

(56) References Cited

U.S. PATENT DOCUMENTS

| | | | | | |
|---|---|---|---|---|---|
| 3,925,029 | A | * | 12/1975 | Wilson | 44/275 |
| 4,205,750 | A | * | 6/1980 | Dews | 53/442 |
| 4,507,077 | A | * | 3/1985 | Sapper | 431/288 |
| 4,714,496 | A | * | 12/1987 | Luken et al. | 44/275 |
| 4,725,286 | A | * | 2/1988 | Brame | 44/533 |
| 4,790,747 | A | * | 12/1988 | O'Brien | 431/288 |
| 4,830,330 | A | * | 5/1989 | Cox et al. | 249/85 |
| 4,840,691 | A | * | 6/1989 | Knape | 53/456 |
| 4,889,284 | A | * | 12/1989 | Spector | 239/34 |
| 4,913,284 | A | * | 4/1990 | Versaci | 53/415 |
| 5,019,424 | A | * | 5/1991 | Strelnieks | 427/443 |
| D392,058 | S | * | 3/1998 | Villecco | D26/7 |
| 6,258,748 | B1 | * | 7/2001 | Hamley | 504/114 |
| 6,296,674 | B1 | * | 10/2001 | Trainor et al. | 44/275 |
| 6,450,802 | B1 | * | 9/2002 | Steck | 44/275 |

OTHER PUBLICATIONS

"How to make Wax Dipped Bears" by Bitter Creek Candle Supply, Inc; 1998.*

Ozark Candle Co. home of Ozark Critter—About us 2002.*

* cited by examiner

*Primary Examiner*—Louis Huynh
(74) *Attorney, Agent, or Firm*—Edward P. Dutkiewicz

(57) ABSTRACT

A toy animal has an interior, an intermediate layer and an exterior layer of wax and a hardener within the wax. The method of fabricating the toy animal comprises the steps of melting a wax, adding a hardener to the melted wax, dipping an interior object into the wax mixture and cooling the coated object.

3 Claims, 3 Drawing Sheets

FIG 1
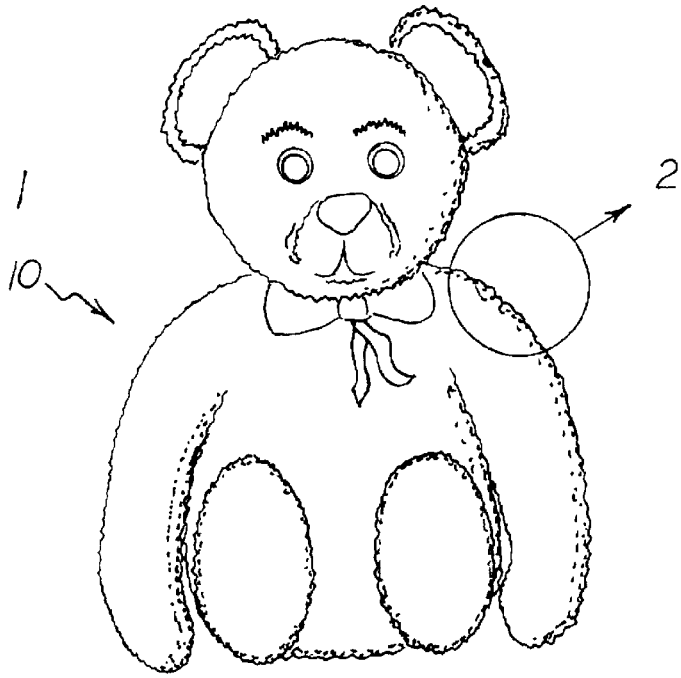
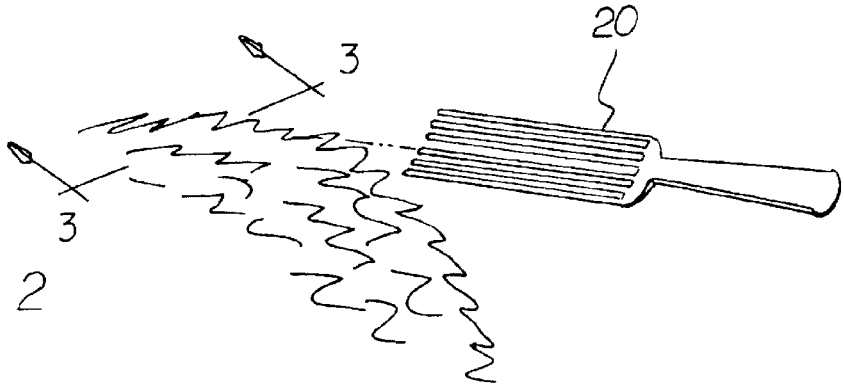
FIG 2

FIG 3
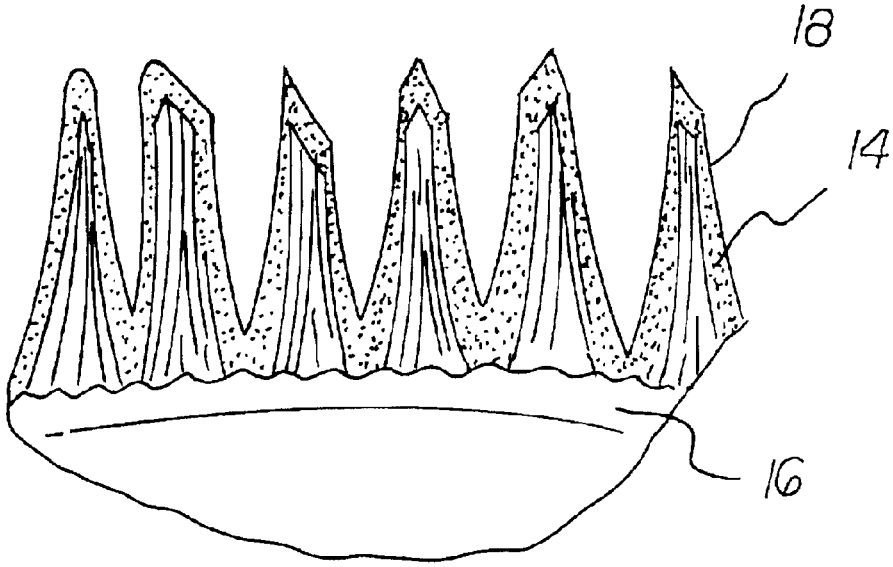
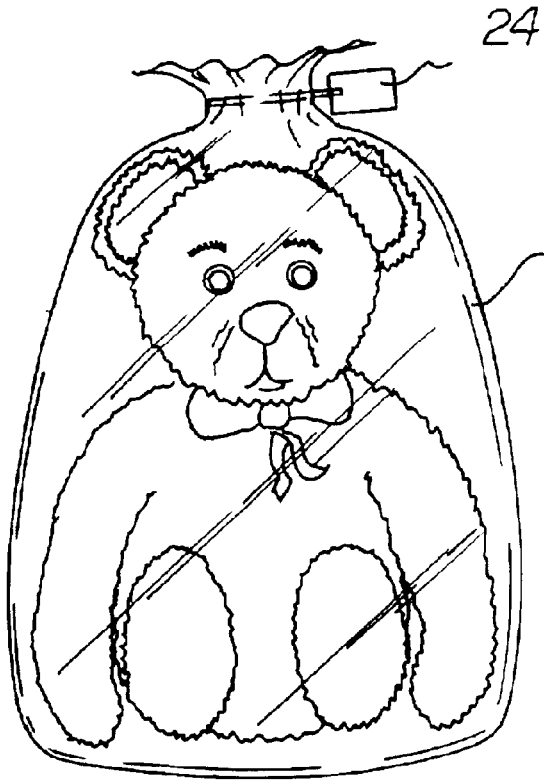
FIG 4

WAX SCENTED ANIMALS AND METHOD OF FABRICATION

BACKGROUND OF THE INVENTION

1. Field of the Invention

The present invention relates to a wax scented animals and method of fabrication and more particularly pertains to fabricating toy animals with a wax coating and picked hair.

2. Description of the Prior Art

The use of toy animals of known designs and configurations is known in the prior art. More specifically, toy animals of known designs and configurations previously devised and utilized for the purpose of fabricating wax objects through conventional methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,077,110 to Rieher discloses a method for making candles. U.S. Pat. No. 4,096,229 to Maivar discloses a method of making a molded article with a textured surface. U.S. Pat. No. 4,507,077 to Sapper discloses a dripless candle. U.S. Pat. No. 4,714,496 to Luken, Jr. et al. discloses wax compositions. U.S. Pat. No. 5,019,424 to Strelnieks discloses a method of producing a decorative container. Finally, U.S. Pat. No. 6,276,925 to Varga discloses a candle and method of making the same.

While these devices fulfill their respective, particular objectives and requirements, the aforementioned patents do not describe a wax scented animals and method of fabrication that allows fabricating toy animals with a wax coating and picked hair.

In this respect, the wax scented animals and method of fabrication according to the present invention substantially departs from the conventional concepts and designs of the prior art, and in doing so provides an apparatus primarily developed for the purpose of fabricating toy animals with a wax coating and picked hair.

Therefore, it can be appreciated that there exists a continuing need for a new and improved wax scented animals and method of fabrication which can be used for fabricating toy animals with a wax coating and picked hair. In this regard, the present invention substantially fulfills this need.

SUMMARY OF THE INVENTION

In view of the foregoing disadvantages inherent in the known types of toy animals of known designs and configurations now present in the prior art, the present invention provides an improved wax scented animals and method of fabrication. As such, the general purpose of the present invention, which will be described subsequently in greater detail, is to provide a new and improved wax scented animals and method of fabrication and method which has all the advantages of the prior art and none of the disadvantages.

To attain this, the present invention essentially comprises an interior of a toy stuffed animal. Next provided is an intermediate layer of artificial hair. Finally, a wax based layer is provided exteriorly. The wax based layer is composed of a paraffin wax, a hardener and a scent. The wax is 1218 wax. The hardener is Weissen R-45. The wax and hardener are mixed in a proportion of about 2 tablespoons of hardener to 24 quarts of wax. The scent is added in a proportion of about 8 ounces to 24 quarts of wax mixture. In addition to the invention being an object, preferably a stuffed toy animal, the invention may also be considered as including the method of fabricating the object. More specifically, such method invention includes melting a hard 1218 paraffin wax having a 140 degree melting point up to between about 150 and 160 degrees. The next step in the method is adding a hardener of Weissen R-45 to the melted wax and mixing the wax and hardener together. The hardener is added in the proportion of about 2 tablespoons of hardener to about 24 quarts of wax. The next step is adding about 8 ounces of scent to the mixed hardener and melted wax and mixing thoroughly to form a scented wax mixture. The next step is dipping a stuffed toy animal into the scented wax mixture. The next step is picking the hair of the toy animal coated with the melted mixture by hand with a hair pick. The next step is cooling the coated and picked animal. The next step is trimming any excess wax from the cooled toy animal. The next step is packaging the toy animal in a transparent container. The final step is adding a label.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wax scented animals and method of fabrication which has all of the advantages of the prior art toy animals of known designs and configurations and none of the disadvantages.

It is another object of the present invention to provide a new and improved wax scented animals and method of fabrication which may be easily and efficiently manufactured and marketed.

It is further object of the present invention to provide a new and improved wax scented animals and method of fabrication which is of durable and reliable constructions.

An even further object of the present invention is to provide a new and improved wax scented animals and method of fabrication which is susceptible of a low cost of manufacture with regard to both materials and labor, and which accordingly is then susceptible of low prices of sale to the consuming public, thereby making such wax scented animals and method of fabrication economically available to the buying public.

Even still another object of the present invention is to provide a wax scented animals and method of fabrication for fabricating toy animals with a wax coating and picked hair.

Lastly, it is an object of the present invention to provide a new and improved toy animal and method of construction having an interior of a toy stuffed animal, an intermediate layer of artificial hair, a wax based layer exteriorly. The wax based layer is composed of a paraffin wax, a hardener and a scent. The wax is 1218 wax. The hardener is Weissen R-45. The wax and hardener are mixed in a proportion of about 2 tablespoons of hardener to 24 quarts of wax. The scent is added in a proportion of about 8 ounces to 24 quarts of wax mixture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of a wax scented animal constructed in accordance with the principles of the present invention.

FIG. 2 is a perspective illustration of a hair pick used to picking the artificial hair on the exterior surface of the animal of FIG. 1.

FIG. 3 is an enlarged cross sectional view taken at Circle 2 of FIG. 1.

FIG. 4 is a front elevational view of the animal of FIG. 1 packaged for storage, transportation and delivery.

The same reference numerals refer to the same parts throughout the various Figures.

DESCRIPTION OF THE PREFERRED EMBODIMENT

Figure 5:
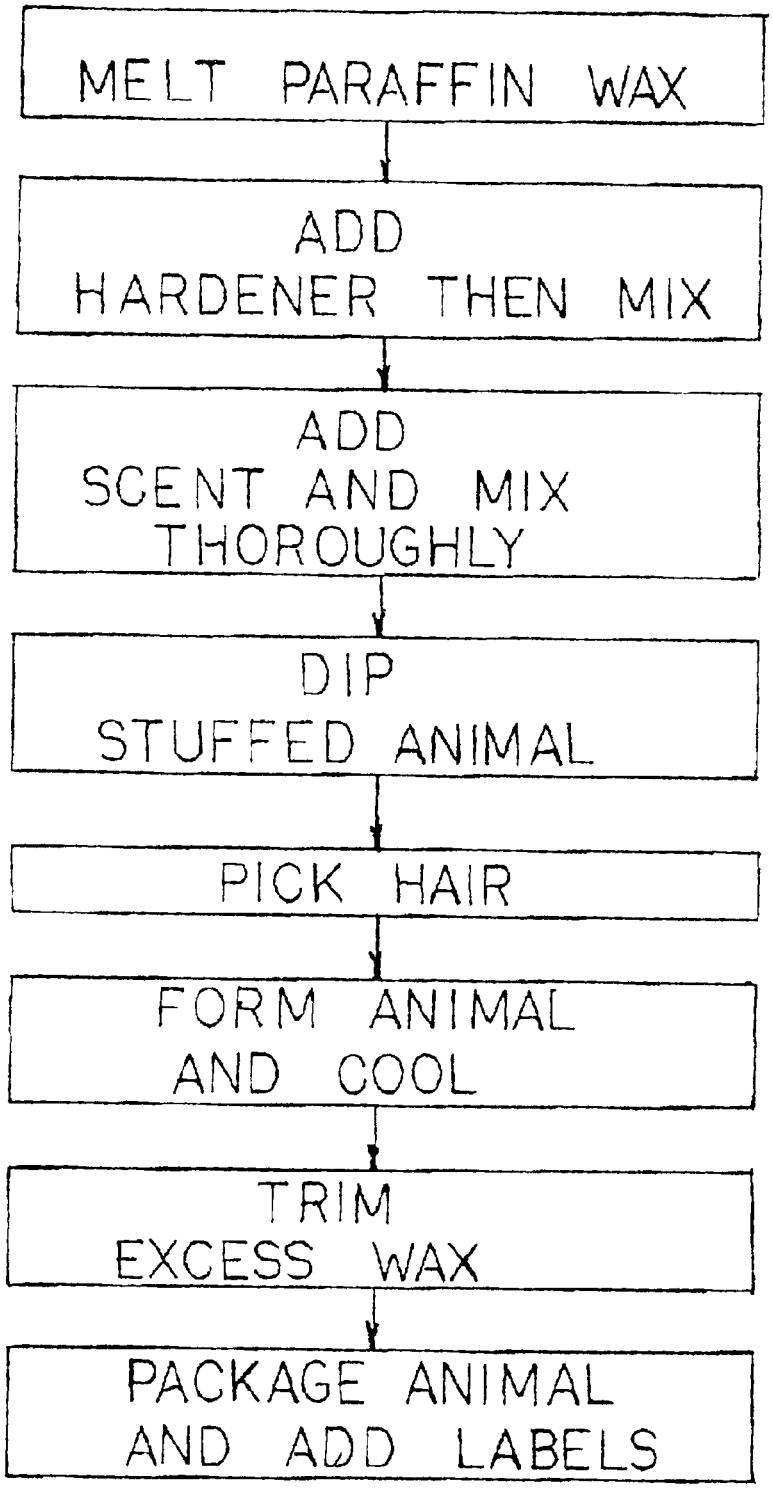
FIG. 5 is a flow diagram of the steps used in fabricating the animal of the prior figures.

With reference now to the drawings, and in particular to FIG. 1 thereof, the preferred embodiment of the new and improved wax scented animals and method of fabrication embodying the principles and concepts of the present invention and generally designated by the reference numeral 10 will be described.

The present invention, the wax scented animals and method of fabrication 10 is comprised of a plurality of components. Such components in their broadest context include an interior, an intermediate layer, and an exterior wax based layer. Such components are individually configured and correlated with respect to each other so as to attain the desired objective.

First provided is an interior of a toy stuffed animal 16. Next provided is an intermediate layer of artificial hair 18. Finally, a wax based layer 14 is provided exteriorly. The wax based layer is composed of a paraffin wax, a hardener and a scent. The wax is 1218 wax. The hardener is Weissen R-45. The wax and hardener are mixed in a proportion of about 2 tablespoons of hardener to 24 quarts of wax. The scent is added in a proportion of about 8 ounces to 24 quarts of wax mixture.

In addition to the invention being an object, preferably a stuffed toy animal, the invention may also be considered as including the method of fabricating the object. More specifically, such method invention includes melting a hard 1218 paraffin wax having a 140 degree melting point up to between about 150 and 160 degrees.

The next step in the method is adding a hardener of Weissen R-45 to the melted wax and mixing the wax and hardener together. The hardener is added in the proportion of about 2 tablespoons of hardener to about 24 quarts of wax.

The next step is adding about 8 ounces of scent to the mixed hardener and melted wax and mixing thoroughly to form a scented wax mixture 14.

The next step is dipping a stuffed toy animal 16 into the scented wax mixture.

The next step is picking the hair 18 of the toy animal coated with the melted mixture by hand with a hair pick 20.

The next step is cooling the coated and picked animal.

The next step is trimming any excess wax from the cooled toy animal.

The next step is packaging the toy animal in a transparent container 22.

The final step is adding a label 24.

The following is the procedure used in making the scented waxed animals. The wax used is a paraffin wax known as 1218 wax. It is a very hard wax with a melting point of 140 degrees. The wax is heated to a temperature of 150–160 degrees and a hardener known as Weissen R-45 is added in the proportion of 2 tablespoons of hardener to 24 quarts of wax. After the hardener and wax are mixed together, 8 ounces of scent is added to the mixture and mixed well. Stuffed animals are then dipped into this scented wax mixture one at a time. Upon removing the stuffed animal from the melted wax mixture, the stuffed animals hair is hand picked with a lady's hair pick while it is draining over the pots. The dipped stuffed animals are then set on tables and posed in the desired finished position to give them their own different look. After the stuffed animals are hard, the excess wax which formed around the bottom of the animal during the drying process is trimmed off. The trimmed animals are then placed in plastic bags and tied with tulle to close the bag. A label with the same scent as the animal enclosed is then place on the font of the plastic bag. A warning label is also placed in the bag.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of fabricating a final object comprising the steps of:

providing an interior object in the form of a stuffed toy animal with artificial hair;

melting a wax;

adding a hardener to the malted wax thereby making a wax mixture;

dipping the interior object into the wax mixture to form a coated object;

removing the coated object from the wax mixture;

picking with a hair pick the hair of the stuffed toy animal with the wax mixture thereover; and cooling the coated object to thereby produce a final product.

2. The method as set forth in claim 1 and further including adding a scent to the mixed melted wax and hardener.

3. A method of fabricating a toy animal object with a stuffed animal interiorly and a scented wax surface exteriorly comprising the steps of:

melting a hard 1218 paraffin wax having a 140 degree melting point up to between about 150 and 160 degrees;

adding a hardener of Weissen R-45 to the melted wax, about 2 tablespoons of hardener to the amount of solid wax necessary to render about 24 quarts of melted wax, then mixing the wax and hardener;

adding about 8 ounces of scent to the mixed melted wax and hardener and mixing thoroughly to form a scented wax mixture;

dipping a stuffed toy animal with articial hair into the scented wax mixture;

removing the stuffed toy animal from the scented wax mixture;

picking the hair of the toy animal coated with the melted mixture by hand with a hair pick;

cooling the coated and picked toy animal;

trimming any existing excess wax from the cooled toy animal;

packaging the toy animal in a transparent container; and adding a label.

* * * * *